United States Patent [19]

Torres

[11] 4,037,567

[45] July 26, 1977

[54] WATER HEATING SYSTEM INCLUDING RECYCLE LOOP

[76] Inventor: Peter L. Torres, 76 Webster Ave., Jersey City, N.J. 07303

[21] Appl. No.: 649,538

[22] Filed: Jan. 15, 1976

[51] Int. Cl.[2] ..... F22B 33/00

[52] U.S. Cl. ..... 122/20 B; 122/421; 137/563; 165/DIG. 2

[58] Field of Search ..... 165/DIG. 2; 237/63, 237/59; 122/20 B, 421; 126/350 R, 362; 137/563, 564

[56] References Cited

U.S. PATENT DOCUMENTS

| | | | |
|---|---|---|---|
| 447,330 | 3/1891 | King | 122/421 X |
| 1,107,534 | 8/1914 | Lovekin | 122/20 B |
| 1,458,876 | 6/1923 | Confer | 122/20 B |
| 2,038,982 | 4/1936 | Broderick | 237/63 X |
| 2,143,287 | 1/1939 | Smith | 122/20 B X |
| 2,189,749 | 2/1940 | Windheim et al. | 122/32 X |
| 2,521,462 | 9/1950 | Kinzelmann | 122/20 B X |
| 3,413,969 | 12/1968 | Whittell, Jr. | 126/362 |

*Primary Examiner*—William E. Wayner
*Assistant Examiner*—William E. Tapolcai, Jr.
*Attorney, Agent, or Firm*—Joel Halpern

[57] ABSTRACT

A water heating system includes a boiler which is connected with a source of water supply for receiving water under pressure. An exhaust flue is connected to the boiler for the discharge of gaseous products of combustion. A pair of concentrically arranged coils is positioned within the exhaust flue and is connected with the conduit feeding water to the boiler. A recycle loop is thus provided for withdrawing a minor portion of the water being fed to the boiler and for recycling same at a higher temperature to the feed conduit. The water circulates within the loop by natural connection.

4 Claims, 2 Drawing Figures

WATER HEATING SYSTEM INCLUDING RECYCLE LOOP

BACKGROUND OF THE INVENTION

The present invention relates to water heating system and more particularly to a water heating system in which there is a recycling of water to increase the thermal efficiency of the system.

Water heating systems have been widely used for many years and take many forms. A typical system is disclosed in U.S. Pat. No. 3,341,122 issued Sept. 12, 1967 to A. Whittel, Jr. In this earlier system a boiler is provided from which flue gases are discharged, water is introduced into the boiler under pressure, and an air separation tank receives heated water from the boiler and from which hot water is extracted for the intended uses. A double set of concentrically wound coils is provided within the air separation tank through which water to be used for various purposes is circulated in heat exchange relation with the heated water from the boiler being deairated in the air separation tank. However, it will be recognized that since the heat exchange is dependent upon the temperature and auantity of water fed to the tank from the boiler, in order to obtain a steady supply of heated water from the coils the boiler must be regulated to constantly provide a sufficient quantity of hot water. This entails operation of the boiler under conditions requiring increased fuel consumption. Concomitantly the hot flue gases being discharged are wasted as a source of heat exchange.

SUMMARY OF THE INVENTION

It is one object of the invention to provide a water heating system which utilizes heat normally wasted to assure a constant supply of heated water.

It is another object of the invention to provide a water heating system in which a recycle loop is included to extract heat from waste gases for the heating of a portion of the boiler feed water and which circulates the water within the recycle loop without the need to furnish any additional power.

Other objects and advantages of the invention will become readily apparent from the following description of the invention.

According to the present invention there is provided in claim 1.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
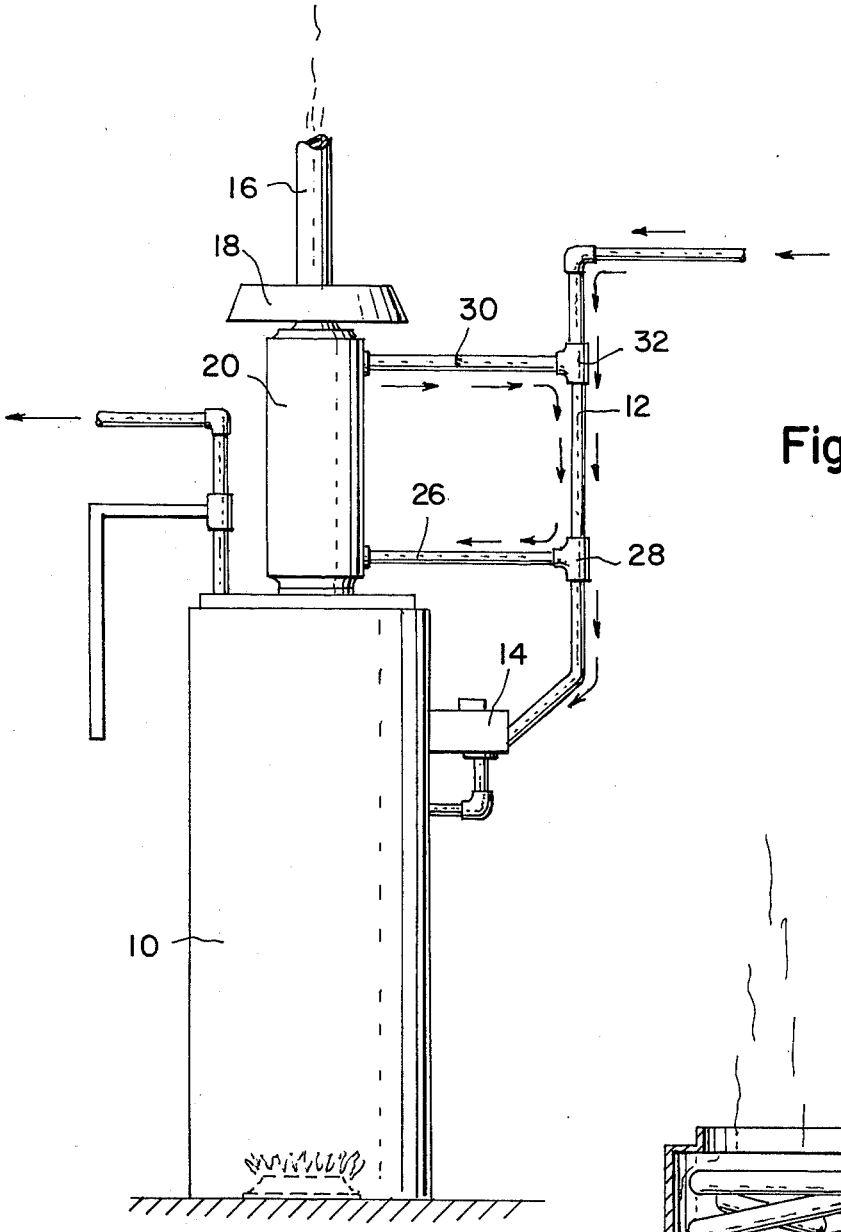
FIG. 1 is a schematic diagram of a water heating system embodying the invention.
Figure 2:
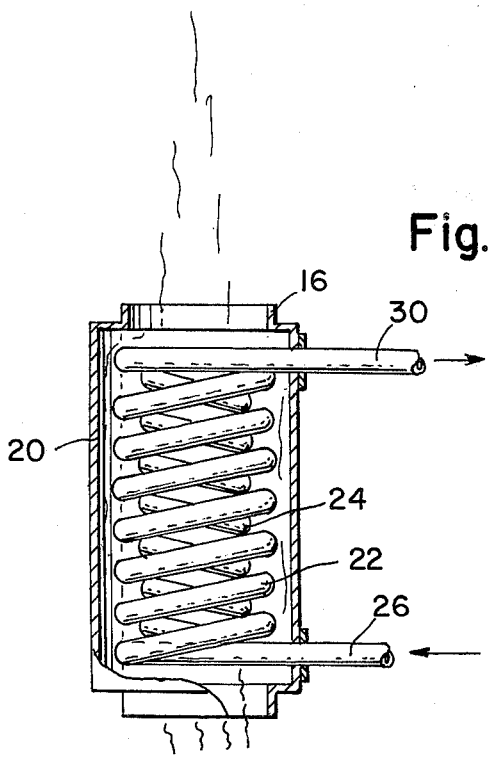
FIG. 2 is a fragmental cross-sectional view of a portion of the exhaust flue with a double concentric coil positioned therein.

Referring to the drawings there is shown a boiler 10 which may be fired by any conventional fuel such as gas, oil or coal. Since the construction of the boiler is conventional and does not form part of the present invention it has been shown in block form. A conduit 12 is connected between the boiler and a source of water supply (not shown) which may be the main of a city service, a well or any other source of water supply. A pump 14 is interposed in conduit 12, preferably adjacent the boiler, to insure force feed of water to the boiler when required.

An exhaust flue 16 is connected to the boiler for the purpose of discharging the products of combustion from within the furnace sector thereof. The usual draft break 18 is provided in the exhaust flue.

Positioned within the exhaust flue, such as within an enlarged portion 20 thereof, is a pair of concentrically arranged coils 22, 24. The coils extend vertically within the exhaust flue and are connected at their lower and upper ends respectively to conduits 26, 30 to be hereafter described the manner of connecting such coils so as to provide for parallel flow is known and involves the use of T-joints, elbows and nipples as is well understood by a mechanic or plumber having ordinary skill in this art. The coils are formed from a material having a high heat conductivity. Copper is a preferred material.

A conduit 26 is connected to conduit 12 at one end as by a T-joint 28, and is connected at its other end to the coils at their lower ends.

Another conduit 30 is connected at one end thereof, such as by T-joint 32, with conduit 12 upstream of the point of connection between conduits 12 and 26. The other end of conduit 30 is connected within the exhaust flue to the upper ends of the coils. There is thus provided a recycle loop for the heating of a minor portion of the water being conducted by conduit 12 to the boiler. The water within the recycle loop is heated by the hot combustion gases flowing through the exhaust flue as they are discharged from the boiler. The water, through natural connection forces, circulates upwardly through the coils and returns to conduit 12 via conduit 30. No additional power is required for the circulation of water through this recycle loop.

The conduits employed for the recycle loop are desirably of smaller internal diameter than that of conduit 12 in order to add to the circulatory effect such as by enhancing the aspiration of water from conduit 12 into conduit 26.

It has been found that with a water heating system such as described in a gas-fired boiler rated at 150,000 B.T.U. imput and 120,000 B.T.U. Output having a capacity of 1050 cubic inches the water temperature in the coils, with only the pilot line on, was maintained at approximately 160° Fahrenheit with a boiler water temperature of 180° Fahrenheit. During operation of the boiler the water temperature in the boiler and in the coils was determined to be approximately the same, i.e., 230° Fahrenheit. Thus, when the boiler is switched into operation the heated water in the recycle loop at a temperature of approximately 160° Fahrenheit is mixed with the water in conduit 12 being fed to the boiler and reduces the amount of firing of the boiler required to bring the water to the desired temperature.

It has been further determined that over a period of 30 days with intermitent boiler operation approximately 20 gallons per hour or 14,400 gallons of heated water is provided through the use of the recycle loop of this invention. Therefore, a significant savings in fuel at no increase in power consumption for the overall heating system has been provided. The provision of the recycle loop also enables the drawing off from the boiler of a constant supply of heated water even during such periods when the boiler is under the influence of only a pilot light.

What is claimed is:

1. In a water heating system which includes a boiler, first conduit means connected between a water supply and said boiler, means for heating the water within and means for supplying water under pressure to said boiler, and an exhaust flue for discharging heated products of combustion from said boiler, the improvement comprising:

at least one coil of heat conductive material positioned within said exhaust flue;

second conduit means connected between said first conduit means and the lower end of said coil for withdrawing a minor portion of the water being conducted to said boiler for passage through said coil in heat exchange relation with the combustion gases discharged through said flue;

and third conduit means connected between the upper end of said coil and said first conduit means upstream of the point of connection between said first and second conduit means for the recycling of heated water to said first conduit means, whereby a recycle loop is provided for the heating of a portion of the water being conducted from said water supply to said boiler.

2. A water heating system according to claim 1, including first and second coils concentrically arranged within said exhaust flue, said coils being in communication at their respective lower and upper ends with said second and third conduits such that water from said second conduit means is heated and caused to flow upwardly simultaneously within both of said coils by means of natural convection and is recycled to said first conduit from said coils through said third conduit means.

3. A water heating system according to claim 1, including a pump in said first conduit downstream of the point of connection between said first and second conduit means and upstream of said boiler.

4. A water heating system according to claim 1, wherein the inner diameter of said second and third conduit means is less than the inner diameter of said first conduit means.

* * * * *